United States Patent [19]

Harner et al.

[11] 4,398,072

[45] Aug. 9, 1983

[54] HIGH-VOLTAGE DEVICE

[75] Inventors: R. H. Harner, Park Ridge; R. T. Swanson, North Riverside; G. J. Zvanut, Skokie, all of Ill.

[73] Assignee: S&C Electric Company, Chicago, Ill.

[21] Appl. No.: 235,334

[22] Filed: Feb. 17, 1981

[51] Int. Cl.[3] ..... H01N 33/12

[52] U.S. Cl. ..... 200/146 R; 200/254; 174/140 R

[58] Field of Search ..... 200/146 R, 254, 256; 174/140 R

[56] References Cited

U.S. PATENT DOCUMENTS 3,549,840 12/1970 Harner ..... 200/146 R

FOREIGN PATENT DOCUMENTS 828861 2/1960 United Kingdom ..... 337/224

*Primary Examiner*—Robert S. Macon

*Attorney, Agent, or Firm*—John D. Kaufmann

[57] ABSTRACT

Erosion- and decomposition-caused deterioration of exterior regions of an arc-extinguishing housing included in a high-voltage switch is eliminated or reduced. The switch also includes a stationary contact within a sealed chamber defined by the housing and a switch blade movable into and out of engagement with the stationary contact through a slit communicating with the chamber. The stationary contact and the switch blade are connectable to opposite sides of a high-voltage source. The deterioration-prone region of the housing resides between one housing portion which is connected to and is at the voltage of the stationary contact, and another portion which is essentially electrically floating. Deterioration is eliminated or reduced by closely capacitively coupling current to the region from a conductive projection connected to the stationary contact. The projection is closely spaced from, and may be either above or below, the region.

26 Claims, 6 Drawing Figures

HIGH-VOLTAGE DEVICE

BACKGROUND OF THE INVENTION

1. Field of the Invention

This invention relates to an improved high-voltage device and, more particularly, to an improved high-voltage switch. More specifically, the present invention relates to an improved high-voltage interrupter switch and to switchgear utilizing the improved switch. The present invention represents an improvement over the switch constructions disclosed in the following commonly-assiged U.S. Pat. Nos. 4,169,973; 3,676,629; 3,671,697; 3,567,967; and 3,549,840.

2. Discussion of the Prior Art

The above commonly-assigned patents relate in varying degrees of particularity to a high-voltage interrupter switch. The switch includes a stationary contact assembly connectable to one side of a high-voltage source and a switch blade connectable to the other side of the source. The switch blade is rotatable into and out of engagement with a stationary contact portion of the stationary contact assembly. The stationary contact is enclosed within a closed chamber defined by an arc-extinguishing housing, sometimes referred to as an arc-compression chute. The housing is made of an ablative arc-extinguishing material, such as a polyurea formaldehyde sold under the trademark Delrin. In moving into and out of engagement with the stationary contact, the switch blade moves through the closed chamber defined by the housing and into and out of a slit formed in the housing communicating with the chamber. The stationary contact assembly and the housing are mechanically attached so that the stationary contact is within the chamber.

Assuming the switch blade to be engaging the stationary contact (switch closed) and the switch to be energized (connected to the voltage source and conducting load current), if the switch blade is rotated away from the stationary contact (switch open) an arc forms between the blade and the stationary contact. The arc impinges on the walls of the chamber defined by the arc-extinguishing housing and evolves therefrom arc-extinguishing gas confined by the closed chamber which de-ionizes, cools and extinguishes the arc. All of the above is well known and is set forth in the above commonly-assigned patents.

Large numbers of switches of the above-described type have been in use for a number of years. Recently, it has been discovered that some of these switches, typically those used in tropical or very humid environments, are experiencing deterioration caused by erosion and decomposition of a portion of the arc-extinguishing housing. The deterioration, if severe enough, may permit the chamber to be partially open to the environment external of the housing which is undesirable because the chamber is intended to be more or less closed and sealed. If the chamber is not closed or sealed, its ability to extinguish arcs formed between the blade and the stationary contact assembly can be compromised. When the above-described deterioration was first detected, the cause therefor was unknown. After prolonged study and testing, the following probable causes and expanations for the deterioration have been postulated.

The deterioration was found to be the heaviest on external surface regions of the housing which were close to or contiguous with those portions of the housing to which the stationary contact assembly was mechanically attached. Study, testing, and analysis indicated that the deterioration of these surface regions is effected by low magnitude leakage current flowing across the surface regions through their distributed surface resistances $r_n$ to ground through small distributed stray capacitances $c_g$ of the entire surface (see FIG. 6) directly from the stationary contact assembly. It was found that these leakage currents, at the voltages involved, could result in partial discharges or arcing on the surface regions of the housing. For purposes hereof, "partial discharge" means one or more electrical discharges that bridge a small part of the surface regions experiencing deterioration. The material of which the housing is made—dictated primarily by the need for the housing to have arc-extinguishing characteristics—was found to be eroded by the partial discharges. In tropical environments, the housing is also decomposed by ozone, oxides of nitrogen and acids. The ozone and nitrogen oxides are produced by the breakdown of air by the partial discharges. The acids are formed by a combination of the oxides of nitrogen and the water found in tropical environments. The water may be in either vapor form or in a condensed layer on the housing.

As the analysis and testing continueed, it was noted that the surface regions undergoing erosion and deterioration are located between distinct two portions of the housing. One of those portions has been previously described, and is that portion of the housing to whch the stationary contact assembly (connected to one side of the voltage source) is mechanically attached. The other portion of the housing is physically remote from the one portion, except for the small, distributed stray capacitance $c_g$ to ground; it is isolated both from ground potential and from the other side of the voltage source. Thus, the voltage of the source, which is connected to the switch blade and to the stationary contact assembly, is essentially not impressed across the two housing portions. Accordingly, this second portion of the housing, which generally constitutes a tip or free edge thereof, is essentially electrically floating. Because the second portion of the housing is essentially electrically floating and does not have the voltage of the source impressed across it and the first portion, the magnitude of leakage current flowing across the surface region through the distributed surface resistances $r_n$ to ground through the small stray capacitance $c_g$ is quite small but is, nevertheless, sufficiently large at high voltage to result in the aforementioned partial discharges which result in the concomitant deterioration of the housing.

All of the above has led to the conclusion that, if a surface region, which would otherwise experience erosion and deterioration, were to be supplied with current from other than the stationary contact assembly, and if the leakage current could be prevented from flowing across the surface region directly from the stationary contact assembly, the deterioration could be eliminated or reduced. It was postulated that capacitively supplying current to the surface region could prevent the partial discharges. Such capacitive coupling of current to the surface region, which current would not flow directly from the stationary contact assembly across the surface region, and would, therefore, produce little or no voltage drop across the surface region, it was further postulated, would prevent adjacent segments of the surface region from having sufficient potential to initiate partial discharges, that is, the surface region would experience a voltage gradient insufficient to initiate partial discharges.

These conclusions and postulations proved correct; closely capacitively coupling current to the surface region through large distributed capacitances $c_n$ (FIG. 6) with a conductive projection closely spaced (typically from about 1/16" to about ⅜") from the region and electrically connected to the stationary contact assembly, indeed, eliminates or reduces deterioration hereof. Placing the projection on the surface region merely moves the deterioration problem to those surface regions adjacent its terminus. Placing the projection too far from the surface region—say, 6 inches—produces too small a capacitance between the projection and the surface region to supply significant capacitive current to the surface region; the majority of the current supplied to the surface region is still supplied directly from the stationary contact assembly and the problem of deterioration remains.

Certain types of prior art shields are not suggestive of the above conclusions and postulations, nor of the desirability of using the conductive projection, because these prior art shields themselves, and the devices with which they are used, differ structurally and functionally from, and produce different results from, the present invention.

Specifically, it is known to include a corona or grading shield directly on or beneath the outer surface of the insulative housing of a high-voltage fuse. Each end of the fuse housing mounts a conductive end ferrule, with one of which the shield is electrically continuous. Unlike the switch housing discussed above, one end of the fuse housing is not at or near the potential of a high-voltage source with the other end of the fuse housing electrically floating: Before the fuse operates, both ends of its housing (and the end ferrules) are at the same high voltage as the source; after the fuse operates, the full high voltage of the source is impressed across the ends (and the ferrules) and, therefore, across the entire fuse housing. Moreover, because the full voltage of the source is impressed across the ends of the fuse housing, leakage currents thereacross can be much higher than those across the surface of the switch housing of the present invention. A fuse shield also is not used to closely capacitively couple current to the fuse housing; its function is to grade the electric field about the fuse and between internal fuse elements and the other end ferrule after operation thereof to prevent external flashover. Thus, the location of a fuse shield is not necessarily critically related to the location of the surface of the fuse housing. Its location is, rather, related to the size, configuration, and extent of those internal fuse elements which are electrically continuous with the one ferrule so that voltage stress exteriorly of the fuse is insufficient for a ionized path to form through the air surrounding the fuse housing.

It is also known to include a corona or grading shield on an insulator or insulator string. Similar to a fuse after its operation, the ends of the insulator or insulator string have high voltage impressed thereacross; typically one end is at the voltage of a line or cable supported thereby while the other end is at the ground potential of a tower or other structure connected thereto. Again, the character of the voltage impressed across an insulator or insulator string and of leakage current across the surface thereof vary from the voltage impressed across and the current flowing across the surface of the switch housing of the invention. The function of the insulator shield is to more evenly distribute voltage stress over the insulator or insulator string. To this end the shield, which has a flared, bell-shaped configuration, is mechanically connected to and surrounds the end of the insulator and is electrically connected to the line or cable. The shield is not, as is the projection of this invention, closely spaced from the insulator surface, but flares away therefrom.

SUMMARY OF THE INVENTION

According to the present invention, then, there is provided apparatus for eliminating or reducing deterioration of a surface region of an insulative member included in a high-voltage device, such as a switch. The device also includes a conductive member, which may be a stationary contact assembly, connectable to one side of an alternating high-voltage source. The surface region is located between first and second portions of the insulative member. The first portion of the member partially defines the boundary of the surface region and abuts or is closely adjacent to the conductive member, which may be mechanically attached thereto. Accordingly, the first portion of the insulative member is at the same or nearly the same voltage as the conductive member. The second portion is remote from the first portion and, except for stray capacitance, is isolated from both ground and the other side of the source so as to be essentially electrically floating. Leakage current supplied to and flowing across the surface region directly from, and at the voltage of, the conductive member is small, but, nevertheless, sufficient to result in the occurrence of partial discharges thereon. The partial discharges lead to erosion and deterioration of the surface region.

The apparatus includes an electrically conductive projection which is electrically connected to the conductive member. The projection is insulated from, and positioned sufficiently close to, the surface region so that a majority of the current supplied to the surface region is current which does not flow across the surface region directly from the conductive member, but is rather supplied via close capacitive coupling between the projection and the surface region. As a consequence, the voltage gradient at the surface region is insufficient for any or a substantial number of partial discharges to occur.

The surface region may be viewed as having a small distributed stray capacitance $c_g$ to ground and distributed surface resistances $r_n$. Viewed in this manner, the current supplied to the surface region via the close capacitive coupling is supplied through large distributed capacitances $c_n$ between the projection and the surface region. The distributed capacitances each have a capacitive reactance $x_n$, wherein $x_n$ is smaller than $r_n$.

The device may be used in tropical environments containing excessive water vapor; a layer of water may form by condensation or the like on the surface region. In this event, leakage current supplied directly from the conductive member heats the layer and causes dry bands or areas to form in the layer. Partial discharges occurring across the dry bands both directly erode the surface region and result in the formation of ozone and oxides of nitrogen by breaking down air. The ozone, the oxides of nitrogen, and acids formed by the oxides of nitrogen and water from the environment or the layer decompose the surface region. The current supplied via the close capacitive coupling between the projection and the surface region obviates deterioration of the surface region from any of these causes.

The projection may either overlie the surface region and be spaced therefrom, or may underlie the surface region and be embedded in the insulative member. In either event the projection is preferably a smoothly contoured metallic member sufficiently elongated so as to be coterminal with the extent of the surface region. If the projection overlies the surface region, it may be coated with or embedded in a layer or body of electrically insulative material separate from the insulative member.

When the high-voltage device is a switch, the insulative member is an arc-compression chute into and out of a chamber of which a switch blade, connected to the other side of the source, is movable for engagement with or disengagement from the stationary contact assembly, which is within the chamber. The present invention also contemplates improved high-voltage switchgear utilizing a high-voltage switch constructed as described above. The high-voltage switchgear may include an electrically grounded metal enclosure which surrounds the switch and the apparatus of the present invention.

DETAILED DESCRIPTION

The present invention constitutes an improvement of the five, commonly-assigned U.S. Patents noted earlier. Of those patents, U.S. Pat. Nos. 4,169,973 and 3,671,697 describe in detail the construction and operation of a high-voltage switch which is illustrated only generally in FIGS. 1 and 2 and which is only generally described here.

Figure 1:
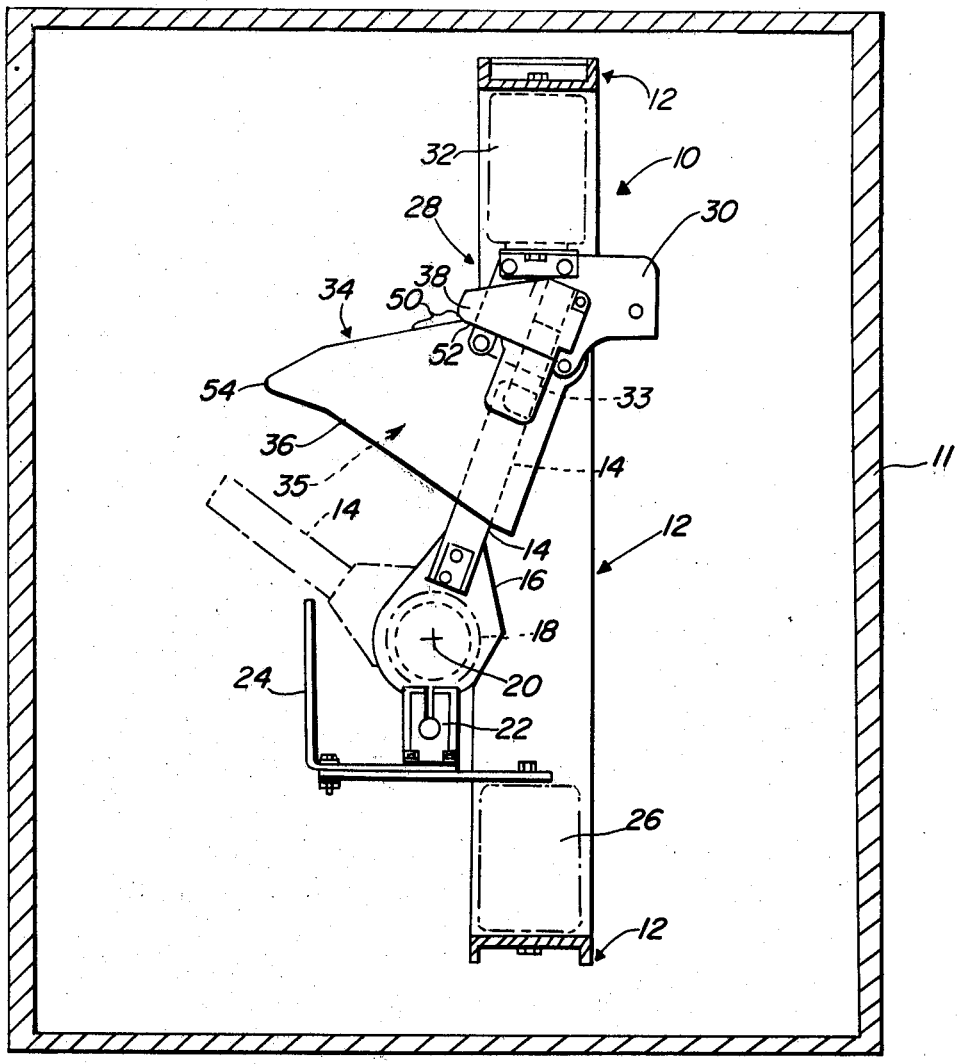
FIG. 1 is a side, partially sectioned elevation showing one switch pole of a polyphase high-voltage switch according to the prior art.

FIG. 1 depicts one pole 10 of a three-phase high-voltage switch, the other two similar poles of which are not shown. The other two switch poles may be aligned with the pole 10 in a direction perpendicular to the plane of FIG. 1. All three switch poles 10 may be located within a metal cabinet or housing 11. The cabinet 11 is typically electrically grounded and may include access doors (not shown) or the like permitting entry into the cabinet 11 for repair, adjustment, or maintenance of the switch poles 10. For a more complete description of this arrangement, see U.S. Pat. No. 3,676,629.

The switch pole 10 is mounted to a metallic frame 12 to which all three switch poles may be commonly mounted. The metallic frame 12 may be mounted, in a manner not depicted in FIG. 1, to walls of the cabinet 11. Each switch pole 10 includes a switch blade 14 that is secured to a metallic switch-blade support 16 which is carried by one or more horizontal insulators 18 appropriately mounted to pivot about a horizontal axis 20. Electrical connection to the switch-blade support 16 is made by a sliding contact 22 which is mounted on and secured to a terminal 24. The terminal 24 is mounted on a lower insulator 26 which is carried by the frame 12.

Each switch pole 10 also includes a stationary contact assembly, generally indicated at 28. The stationary contact assembly 28 includes a contact support terminal bracket 30 that is mounted on an upper insulator 32 in any convenient fashion. A contact subassembly 33 of the stationary contact assembly 28 is enclosed within a chamber of an arc-extinguishing housing or arc chute generally indicated at 34. The arc-extinguishing housing 34 is secured in any convenient fashion to the contact support bracket 30. The insulator 18 and the switch blade 14 are selectively pivotable between the switch opened (solid lines) and the switch closed (phantom lines) positions about the horizontal axis 20 by a manual or automatic switch operator (not shown) as disclosed in the aforenoted commonly-assigned patents.

The switch blade 14 is arranged to move through a slot 35 in the arc-extinguishing housing 34. The slot 35 and the chamber, with which the slot communicates, are defined by a pair of plates or covers 36 which are mounted together to form the housing 34. The stationary contact assembly 28—specifically, a portion of the support bracket 30 and the contact subassembly 33—is located in part between the plates 36 and also between a pair of cover sections 38 (removed in FIG. 2) which may be formed integrally with or otherwise attached to the plates or covers 36.

Figure 2:
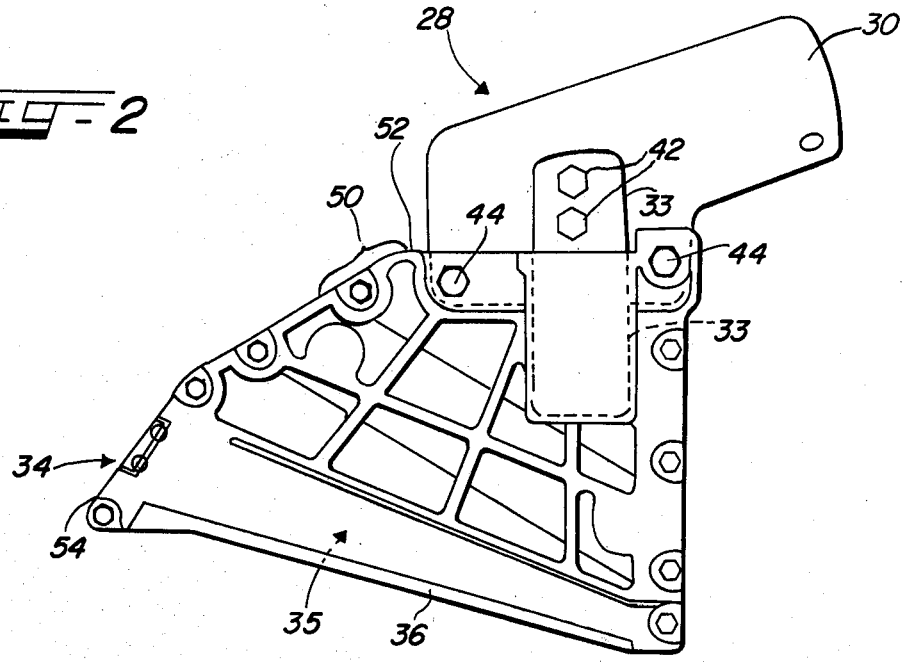
FIG. 2 is a magnified side elevation of a portion of the switch pole depicted in FIG. 1.

As generally depicted in FIGS. 1 and 2, the stationary contact assembly 28 incudes the terminal bracket 30 and the contact subassembly 33. The contact subassembly 33, which may be configured as variously described in any of the above-identified commonly-assigned patents, extends into the chamber defined by the housing 34 and between its plates or covers 36. The contact subassembly 33 may be mounted by screws 42 or the like to the terminal bracket 30. The terminal bracket 30 in turn is mounted between the plates or covers 36 of the housing 34 and is held in place by bolts 44 or the like.

One side of a high-voltage source is connectable to the terminal bracket 30; the other side of the source is connectable to the stationary terminal 24 (FIG. 1). When the switch pole 10 is closed and the switch blade 14 contacts the contact subassembly 33, current flows through the switch pole 10 via the contact subassembly 33 and the blade 14 between the terminal bracket 30 and the stationary terminal 24. When the switch pole is opened by rotation of the horizontal insulator 18, the blade 14 disengages the contact subassembly 33. While the blade 14 is still within the chamber defined by the housing 34, an arc forms between the blade 14 and the contact subassembly 33. This arc interacts with the material of the housing 34 to evolve and ablate within the chamber high quantities of cooling, de-ionizing, arc-extinguishing gas which ultimately extinguish the arc. The switch blade 14 ultimately assumes he full open position shown in phantom in FIG. 1.

The switch pole 10, as generally described above, has been found to operate quite satisfactorily in the field. However, after some years of use, reports were received of deterioration of certain regions of the surface of the housing 34. This deterioration is undesirable inasmuch as the chamber defined by the housing 34 and into which the contact subassembly 33 extends is desirably kept as firmly sealed as possible in aid of the arc-extinguishing action of gas evolved from the housing 34 when the blade 14 disengages the contact subassembly 33. The surface region where deterioration was most pronounced is indicated by the reference numeral 50 in FIGS. 1 and 2. The deterioration of the surface of the housing 34 at the surface regions 50 was most pronounced in humid use environments. The surface region 50, it will be noted, is located between a first portion 52 and a second portion 54 of the exterior surface of the housing 34. The first portion 52 is that portion of the exterior surface of the housing 34 abutting or immediately adjacent the point of connection of the terminal bracket 30 to the housing 34. The second portion is a tip or free edge of the housing 34 which is physically remote from the first portion 52 and represents the leftwardmost extension of the housing 34, as depicted in FIGS. 1 and 2.

It has been found, for reasons previously discussed, that if current is supplied to the surface region 50 via close capacitive coupling between the region 50 and a conductive member at the same potential as the terminal bracket 30, the deterioration of the surface region 50 is substantially reduced or eliminated. Apparatus for supplying such a current in this manner is depicted in FIGS. 3–5.

Figure 3:
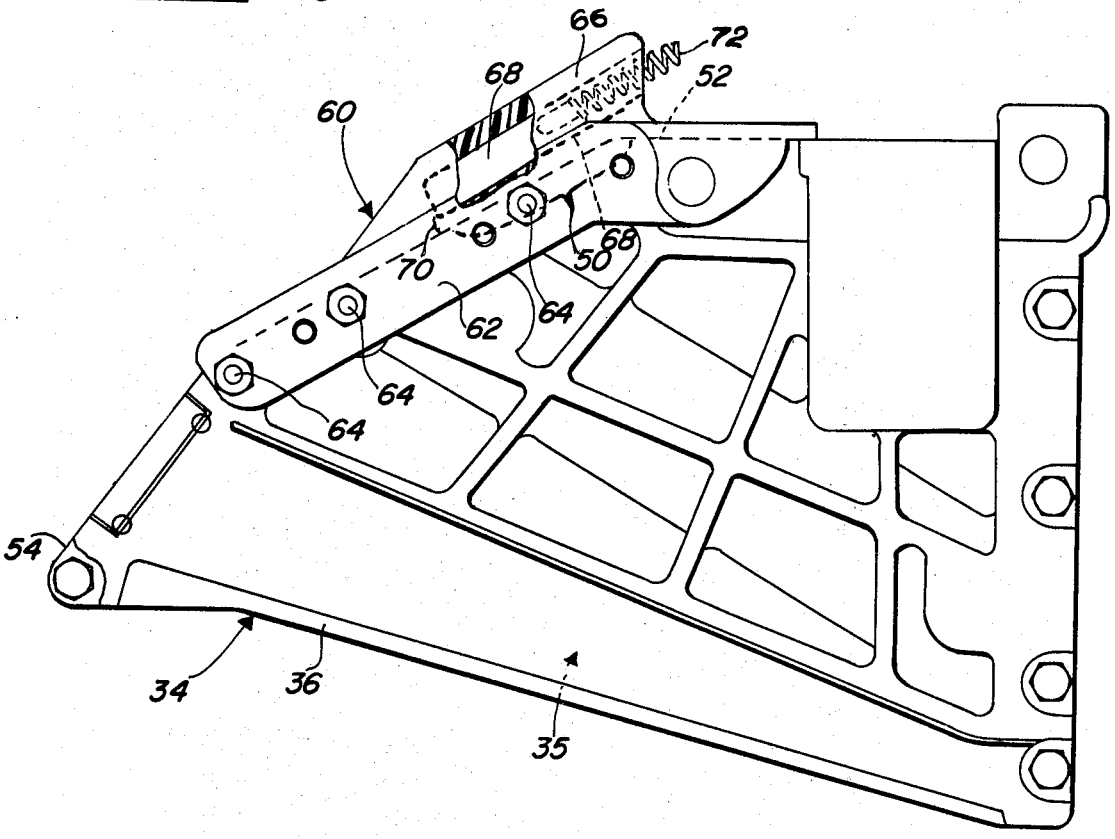
FIGS. 3, 4, and 5 are three alternative embodiments of the present invention depicting facilities for modifying and improving the switch pole depicted in FIGS. 1 and 2.

FIG. 3 illustrates a shroud 60 which may be mounted to the housing 34 for eliminating the deterioration thereof at the surface region 50. The shroud 60 includes a body portion 62 made of polyethylene or a similar material and configured so as to straddle and overlie the housing 34 from the first portion 52 to a point close to the second portion 54. The body portion 62 may contain a plurality of holes and may be held to the housing 34 by a plurality of screws or the like 64 which are also used to hold the covers or plates 36 of the housing 34 together. The body portion 62 includes a contoured upper portion 66 which contains a rounded and contoured metallic conductive projection or electrode 68. When the shroud 60 is mounted to the housing 34, the projection 68 is held within the upper portion 66 so as to be quite close to the upper surface of the housing 34 as depicted by the dimension 70. Where the switch poles 10 are used at 15 kV or 25 kV, the dimension 70 may typically be from about 1/16" to about ⅜". The right end of the projection 68 may contain a blind bore into which a conductive spring 72 is placed as depicted. The spring 72 is selected to compressionally engage the front portion of the terminal bracket 3 (not shown in FIG. 3) when the shroud 60 is in place. In this way, the projection 68 is maintained at the same potential as that of the terminal bracket 30 and the contact subassembly 40.

The extension of the projection 68 and its close spacing 70 to the surface region 50 causes the projection 68 to supply current to the surface region 50 through large distributed capaciances $c_n$ (see FIG. 6) via close capacitive coupling therebetween. This capacitively supplied current causes there to be an insufficient voltage gradient at the surface region 50 for partial discharges to occur thereat. These partial discharges would either directly deteriorate the surface region 50 by erosion, or would indirectly deteriorate the region 50 by breaking down air, water, and contaminants in humid environments, which breakdown leads to the formation of ozone, oxides of nitrogen, and acids, which decompose the region 50.

Figure 4:
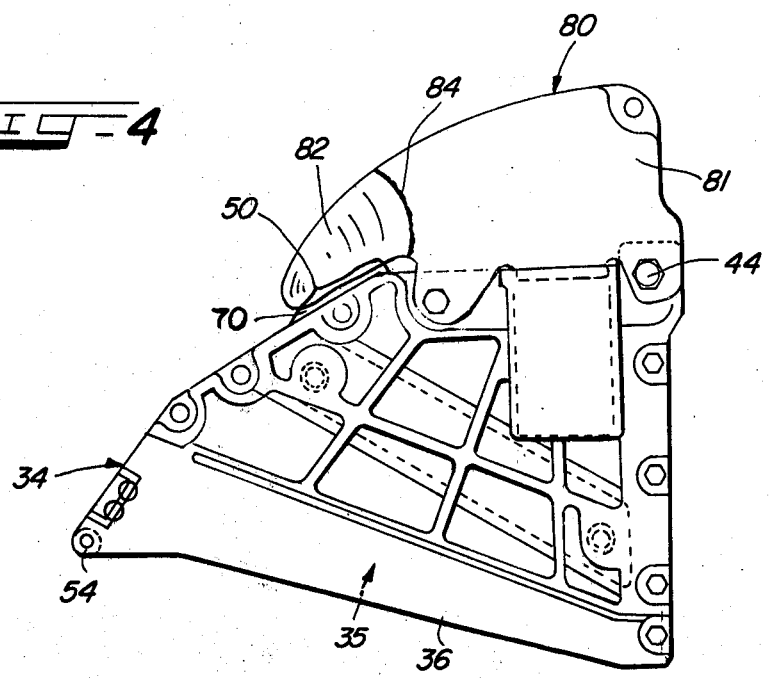
Figure 5:
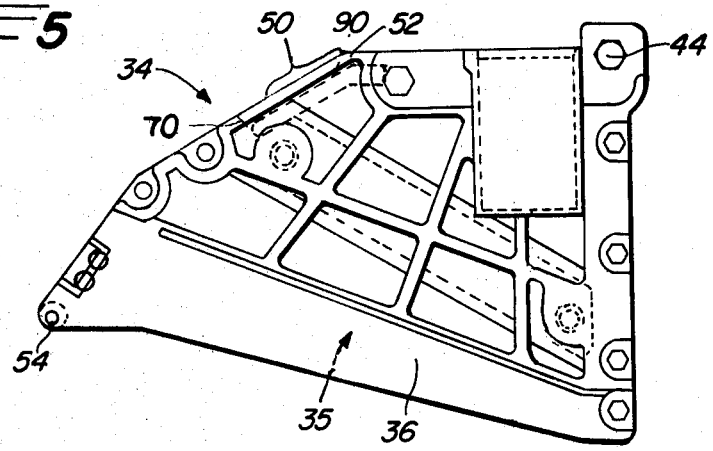

FIGS. 4 and 5 illustrate alternative embodiments of the apparatus shown in FIG. 3. Specifically, FIG. 4 depicts a contact cover 80 modified with respect to, and replacing, the contact cover 38 illustrated in FIG. 1. The contact cover 80 includes two similar mirror-image members 81 made of conductive metal and attached so that the cover 80 straddles the housing 34 and the covers or plates 36 thereof. Two members 81 are used so that the terminal bracket 30 and the contact subassembly 33 (neither is shown in FIG. 4) may be inserted into the chamber defined by the housing 34. Each member 81 includes a finger-like projection 82 extending leftwardly, as depicted in FIG. 4, so as to overlie and be generally coterminal with the extent of the surface region 50. Similar to the embodiment depicted in FIG. 3, the projections 82 supply closely capacitively coupled current to the surface region 50 to prevent erosion and deterioration thereof. If desired, the projections 82 may be covered with an insulative layer 84 to prevent flashovers between the switch poles 10 during opening and closing of the switch blades 14.

The embodiment of FIG. 5 is similar to the embodiments of FIGS. 3 and 4, except that a metallic projection 90 is contained within one or both of the plates or covers 36 of the housing 34 itself. Thus, in contrast to the previous two embodiments, the projection 90 of FIG. 5 underlies rather than overlies the surface region 50. Appropriate facilites, not shown but which may be similar to the spring 72 in FIG. 3, may be used to ensure that the projection 90 is continuously electrically connected to the terminal bracket 30 to closely capacitively supply current to the surface region 50.

Figure 6:
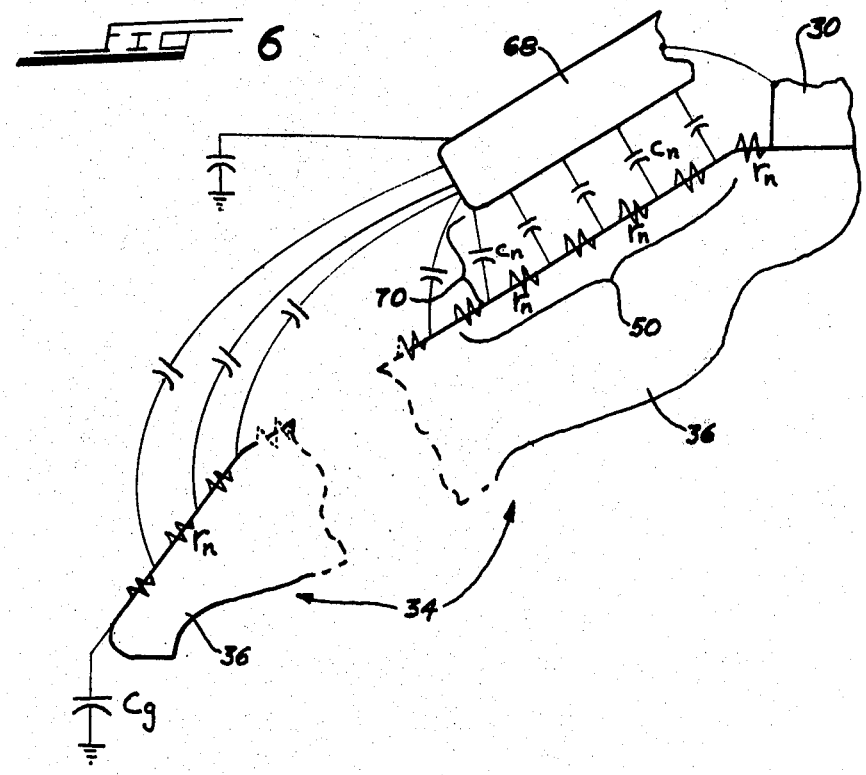
FIG. 6 is a schematic depiction of various distributed electrical parameters of the embodiment of the invention shown in FIG. 3.

Assuming one of the projections 68, 82, or 90 to be not present, if the surface region 50 is substantially dry, energization of the terminal bracket 30 will supply very low magnitude leakage current which flows across the surface region 50 through the high distributed resistances $r_n$ thereof to ground through the distributed stray capacitance $c_g$ (see FIG. 6). This leakage current flows across the surface region 50 directly from the energized terminal bracket 30 and may result in some partial discharges which might directly deteriorate the surface region 50 by erosion thereof. However, if the surface region 50 is covered with a more or less continuous layer of water or contaminants formed, for example, by condensation from a humid use environment, a small, but larger, leakage current supplied directly by the terminal bracket 30 flows across the surface region 50 and the layer. It has been found that, when such a layer is present, the flow of current thereacross ultimately results in the formation of dry bands in the formerly continuous layer. Partial discharges subsequently occur across these dry bands. These partial discharges both directly erode the surface region 50, as well as break down the surrounding air and the water and contaminants of the layer into constituents—such as ozone, oxides of nitrogen, and acids—which further decompose the surface region 50.

When the metallic projection 68, 82, or 90 is present as hereinbefore described, the majority of the current supplied to the surface region 50 is supplied through the large distributed capacitances $c_n$ via the close capacitive coupling between the projection 58, 82, or 90 and the surface region 50, rather than by flow across the surface region 50 directly from the terminal bracket 30. Moreover, whether the surface region 50 is dry or is covered with the layer, the projection 68, 82, or 90 tends to shunt current away from the path directly supplied by the terminal bracket 30 to supply the current to the region 50 via the close capacitive coupling. This capacitively supplied current has been found to prevent sufficient potential difference between adjacent segments of the surface region 50 for the initiation of the partial discharges, that is, it has been found that the presence of the projections 68, 82, and 90 prevents the surface region 50 from experiencing sufficient voltage gradient to initiate the partial discharges.

We claim:

1. Apparatus for eliminating or reducing the deterioration of a surface region of an insulative member included in a high-voltage device which also includes a conductive member connectable to one side of a source of alternating high voltage; the surface region being located between first and second portions of the insulative member; the first portion (i) partially defining the boundary of the surface region, (ii) abutting or being closely adjacent to the conductive member, and (iii) being at the same or nearly the same voltage as the conductive member; the second portion being remote from the first portion and, except for stray capacitance, being isolated from both ground and the other side of the source so as to be essentially electrically floating; leakage current supplied to, and flowing across, the surface region directly from and at the voltage of the conductive member being small but, nevertheless, sufficient to result in the occurrence of partial discharges thereon, which partial discharges erode and deteriorate the surface region; wherein the apparatus comprises:

an electrically conductive projection electrically connected to the conductive member, the projection being insulated from and positioned sufficiently close to the surface region so that a majority of the current supplied to the surface region is current which does not flow across the surface region directly from the conductive member, but is rather supplied via close capacitive coupling between the projection and the surface region, whereby the voltage gradient at the surface region is insufficient for any, or a substantial number of, partial discharges to occur.

2. Apparatus for eliminating or reducing the deterioration of a surface region of an insulative member included in a high-voltage device which also includes a conductive member connectable to one side of a source of alternating high voltage; the surface region having distributed surface resistances $r_n$ and being located between first and second portions of the insulative member; the first portion (i) partially defining the boundary of the surface region, (ii) abutting or being closely adjacent to the conductive member, and (iii) being at the same or nearly the same voltage as the conductive member; the second portion being remote from the first portion and, except for stray capacitance, being isolated from both ground and the other side of the source so as to be electrically floating; leakage current supplied to, and flowing across, the surface region directly from and at the voltage of the conductive member being small but, nevertheless, sufficient to result in the occurrence of partial discharges thereon, which partial discharges erode and deteriorate the surface region; wherein the apparatus comprises:

an electrically conductive projection electrically connected to the conductive member, the projection being insulated from and positioned sufficiently close to the surface region so that a majority of the current supplied to the surface region is current which does not flow across the surface region directly from the conductive member, but is rather supplied via close capacitive coupling between the projection and the surface region through distributed capacitances each having a capacitive reactance $x_n$, wherein $r_n > x_n$, whereby the voltage gradient at the surface region is insufficient for any, or a substantial number of, partial discharges to occur.

3. Apparatus as in claim 1 or 2, wherein the surface region of the insulative member is external of the device.

4. Apparatus as in claim 3, wherein the projection overlies and is spaced from the surface region.

5. Apparatus as in claim 4, wherein the projection is a smoothly contoured, metallic member elongated so as to be substantially coterminal with the extent of the surface region.

6. Apparatus as in claim 5, wherein the metallic member is coated with or embedded in a layer or body of electrically insulative material separate from the insulative member.

7. Apparatus as in claim 6, wherein the device is a high-voltage interrupter switch, the insulative member is an arc-compression chute into and out of a chamber of which a switch blade is movable, and the conductive member is a metallic assembly to which the arc chute is mounted and which supports within the chamber a stationary contact selectively engaged and disengaged by the switch blade.

8. High-voltage switchgear which includes the apparatus and switch of claim 7 and which further comprises:

an electrically grounded, metal enclosure surrounding the switch and the apparatus.

9. Apparatus as in claim 3, wherein the projection underlies and is spaced from the surface region.

10. Apparatus as in claim 9, wherein the projection is a smoothly contoured, metallic member embedded in the insulative member and elongated so as to be substantially coterminal with the extent of the surface region.

11. Apparatus as in claim 10, wherein the device is a high-voltage interrupter switch, the insulative member is an arc-compression chute into and out of a chamber of which a switch blade is movable, and the conductive member is a metallic assembly to which the arc chute is mounted and which supports within the chamber a stationary contact selectively engaged and disengaged by the switch blade.

12. High-voltage switchgear which includes the apparatus and switch of claim 11, and which further comprises an electrically grounded, metal enclosure surrounding the switch and the apparatus.

13. Apparatus as in claim 1 or 2, wherein the insulative member is made of an organic material and the device is locatable in use environments containing water vapor from which a layer of water may form by condensation or the like on the surface region, and wherein the small leakage current supplied directly from the conductive member causes dry bands to form in the layer and initiates the partial discharges acroos the dry bands, which partial discharges (a) erode the surface region and (b) break down air into ozone and oxides of nitrogen, the oxides of nitrogen combining with the water vapor and and water to form acids, all of which decompose the surface region.

whereby supplying the current via the close capacitive coupling between the projection and the surface region eliminates or reduces erosion and decomposition and the consequent deterioration of the surface region attributable to both causes (a) and (b).

14. Apparatus as in claim 13, wherein the device is a high-voltage interrupter switch, the insulative member is an arc-compression chute into and out of a chamber of which a switch blade is movable, and the conductive member is a metallic assembly to which the arc chute is mounted and which supports within the chamber a stationary contact selectively engaged and disengaged by the switch blade.

15. Apparatus as in claim 13, wherein
the surface region of the insulative member is external of the device.

16. Apparatus as in claim 15, wherein
the projection overlies and is spaced from the surface region.

17. Apparatus as in claim 16, wherein
the projection is a smoothly contoured, metallic member elongated so as to be substantially coterminal with the extent of the surface region.

18. Apparatus as in claim 17, wherein
the metallic member is coated with or embedded in a layer or body of electrically insulative material separate from the insulative member.

19. Apparatus as in claim 18, wherein the device is a high-voltage interrupter switch, the insulative member is an arc-compression chute into and out of a chamber of which a switch blade is movable, and the conductive member is a metallic assembly to which the arc chute is mounted and which supports within the chamber a stationary contact selectively engaged and disengaged by the switch blade.

20. High-voltage switchgear which includes the apparatus and switch of claim 19 and which further comprises:
an electrically grounded, metal enclosure surrounding the switch and the apparatus.

21. Apparatus as in claim 13, wherein
the projection underlies and is spaced from the surface region.

22. Apparatus as in claim 20, wherein
the projection is a smoothly contoured, metallic member embedded in the insulative member and elongated so as to be substantially coterminal with the extent of the surface region.

23. Apparatus as in claim 22, wherein the device is a high-voltage interrupter switch, the insulative member is an arc-compression chute into and out of a chamber of which a switch blade is movable, and the conductive member is a metallic assembly to which the arc chute is mounted and which supports within the chamber a stationary contact selectively engaged and disengaged by the switch blade.

24. High-voltage switchgear which includes the apparatus and switch of claim 23, and which further comprises
an electrically grounded, metal enclosure surrounding the switch and the apparatus.

25. Apparatus as in claim 1 or 2, wherein the device is a high-voltage interrupter switch, the insulative member is an arc-compression chute into and out of a chamber of which a switch blade is movable, and the conductive member is a metallic assembly to which the arc chute is mounted and which supports within the chamber a stationary contact selectively engaged and disengaged by the switch blade.

26. High-voltage switchgear which includes the apparatus and switch of claim 25 and which further comprises:
an electrically grounded, metal enclosure surrounding the switch and the apparatus.

* * * * *